US009388806B2

(12) United States Patent
Lee et al.

(10) Patent No.: US 9,388,806 B2
(45) Date of Patent: Jul. 12, 2016

(54) RECIPROCATING COMPRESSOR

(71) Applicant: LG ELECTRONICS INC., Seoul (KR)

(72) Inventors: Jongkoo Lee, Seoul (KR); Jungsik Park, Seoul (KR); Suho Park, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 202 days.

(21) Appl. No.: 14/051,916

(22) Filed: Oct. 11, 2013

(65) Prior Publication Data

US 2014/0105764 A1 Apr. 17, 2014

(30) Foreign Application Priority Data

Oct. 12, 2012 (KR) ..... 10-2012-0113795

(51) Int. Cl.

| | |
|---|---|
| ***F04B 35/04*** | (2006.01) |
| ***F04B 39/00*** | (2006.01) |
| ***F04B 53/14*** | (2006.01) |
| ***F04B 39/02*** | (2006.01) |
| ***F04B 39/12*** | (2006.01) |
| *F04B 17/04* | (2006.01) |

(52) U.S. Cl.

CPC ..... *F04B 53/146* (2013.01); *F04B 35/04* (2013.01); *F04B 35/045* (2013.01); *F04B 39/023* (2013.01); *F04B 39/121* (2013.01); *F04B 39/122* (2013.01); *F04B 39/127* (2013.01)

(58) Field of Classification Search

CPC ..... F04B 35/04; F04B 17/04; F04B 9/025; F04B 17/03

See application file for complete search history.

(56) References Cited

U.S. PATENT DOCUMENTS

| | | | | |
|---|---|---|---|---|
| 6,881,042 | B2 | 4/2005 | Heo et al. | |
| 2003/0175135 | A1 * | 9/2003 | Heo | F04B 35/045 417/363 |
| 2004/0057844 | A1 * | 3/2004 | Park | F04B 35/045 417/360 |

(Continued)

FOREIGN PATENT DOCUMENTS

| | | |
|---|---|---|
| CN | 1443280 A | 9/2003 |
| CN | 1485541 A | 3/2004 |

(Continued)

OTHER PUBLICATIONS

European Search Report dated May 27, 2015.

(Continued)

*Primary Examiner* — Bryan Lettman
*Assistant Examiner* — Thomas Cash
(74) *Attorney, Agent, or Firm* — KED & Associates LLP

(57) ABSTRACT

A reciprocating compressor is provided that may include an outer stator; an inner stator provided at an inner side of the outer stator with a predetermined gap therebetween; a mover configured to perform a reciprocating movement in the gap between the outer stator and the inner stator; a piston coupled to the mover to perform a reciprocating movement therewith; a cylinder, into which the piston may be inserted to form a compression space while performing a reciprocating movement; a frame coupled to the cylinder; a first support member coupled to the outer stator and the frame; and a second support member separated from the first support member, but coupled to the inner stator and the frame, thereby facilitating concentricity of the motor and compressor device, as well as simplifying an assembly process as the motor and compressor device are divided into several blocks for assembly.

20 Claims, 7 Drawing Sheets

(56) References Cited

U.S. PATENT DOCUMENTS

| | | | | |
|---|---|---|---|---|
| 2009/0280015 | A1 | 11/2009 | Lillie et al. | |
| 2013/0004343 | A1* | 1/2013 | Cho | F04B 35/045 417/321 |

FOREIGN PATENT DOCUMENTS

| | | | |
|---|---|---|---|
| CN | 1637286 | A | 7/2005 |
| CN | 1975160 | A | 6/2007 |
| CN | 101552531 | A | 10/2009 |
| CN | 101835975 | A | 9/2010 |
| KR | 10-2002-0073840 | | 9/2002 |
| KR | 10-2002-0090014 | | 11/2002 |
| KR | 10-2003-0029767 | | 4/2003 |
| KR | 20060128128 | A | 12/2006 |
| KR | 10-2008-0069081 | | 7/2008 |
| WO | WO 2009/054636 | | 4/2009 |

OTHER PUBLICATIONS

Korean Office Action dated Mar. 25, 2014.

Chinese Office Action dated Sep. 16, 2015 issued in Application No. 201310474585.6 (English Translation).

* cited by examiner

RECIPROCATING COMPRESSOR

CROSS-REFERENCE TO RELATED APPLICATION(S)

Pursuant to 35 U.S.C. §119(a), this application claims priority to Korean Application No. 10-2012-0113795, filed in Korea on Oct. 12, 2012, which is herein expressly incorporated by reference in its entirety.

BACKGROUND

1. Field

A reciprocating compressor is disclosed herein.

2. Background

In general, a reciprocating compressor employs a method of inhaling, compressing, and discharging refrigerant while a piston performs a reciprocating movement at high speed within a cylinder. The reciprocating compressor may be divided into a connection type and a vibration type according to a driving method of its piston.

A connection type reciprocating compressor employs a method in which a piston is connected to a rotation shaft of a rotation motor to compress refrigerant while performing a reciprocating movement within a cylinder. In contrast, a vibration type reciprocating compressor employs a method in which a piston is connected to a mover of a reciprocating motor to compress refrigerant while performing a reciprocating movement using vibration within a cylinder. Embodiments disclosed herein relate to a vibration type reciprocating compressor, and hereinafter, the vibration type reciprocating compressor will be referred to as a reciprocating compressor.

FIG. 1 is a cross-sectional view of a related art reciprocating compressor. As illustrated in FIG. 1, in a reciprocating compressor according to the related art, a frame 20 may be elastically supported by a plurality of support springs 61, 62 at an inner space 10*a* of an enclosed shell 10, and an outer stator 31 and an inner stator 32 of a reciprocating motor 30 forming a motor (M) and a cylinder 41 forming a compressor device (C), which will be described later, may be provided on the frame 20. The cylinder 41 may be provided within a range of being overlapped with the stators 31, 32 of the reciprocating motor 30 in an axial direction.

A piston 42 coupled to a mover 33 of the reciprocating motor 30 to form the compressor device (C) along with the cylinder 41 may be inserted into and coupled to the cylinder 41 to perform a reciprocating movement, and a plurality of resonant springs 51, 52 to include a resonant movement of the piston 42 may be provided at both sides of a movement direction of the piston 42, respectively.

Further, a suction pipe 11 connected to an evaporator (not shown) of a refrigeration cycle apparatus may be provided to communicate with the inner space 10*a* of the shell 10, and a discharge pipe 12 connected to a condenser (not shown) of the refrigeration cycle apparatus may be provided to communicate with one side of the suction pipe 11.

Furthermore, a compression space (S1) may be formed in the cylinder 41, a suction passage (F) to guide refrigerant to the compression space (S1) may be formed on the piston 42, a suction valve 43 to open and close the suction passage (F) may be provided at an end of the suction passage (F), and a discharge valve 44 to open and close the compression space (S1) of the cylinder 41 may be provided at a leading end surface of the cylinder 41.

Unexplained reference numerals 35, 36 and 45 in FIG. 1 denote a coil, a magnet, and a valve spring, respectively.

According to the above-described related art reciprocating compressor, when power is applied to the coil 35 of the reciprocating motor 30, the mover 33 of the reciprocating motor 30 may perform a reciprocating movement. Then, the piston 42 coupled to the mover 33 may inhale refrigerant into the inner space 10*a* of the piston 42 through the suction pipe 11 while performing a reciprocating movement at high speed within the cylinder 41 at the inner space 10*a* of the shell 10. Then, refrigerant at the inner space 10*a* of the shell 10 may be inhaled into the compression space (S1) of the cylinder 41 through the suction passage (F) of the piston 42, and discharged from the compression space (S1) during a forward movement of the piston 42, thereby repeating a series of processes of moving refrigerant to the condenser of the refrigeration cycle apparatus through the discharge pipe 12.

However, according to the above-described related art reciprocating compressor, the compressor device (C) may be provided in an overlapping manner at an inner side of the motor (M), and therefore, a magnetic flux generated by the motor (M) may be leaked to the compressor device (C) along the frame 20, increasing motor loss, and the reciprocating movement of the piston 42 may be destabilized by the magnetic flux leaked to the compressor device (C). If the cylinder 41 and piston 42 are formed of a non-magnetic material to prevent the magnetic flux of the motor (M) from being leaked to the compressor device (C), it may cause a problem of increasing production costs and reducing reliability of the compressor due to low abrasion resistance.

In addition, according to the above-described related art reciprocating compressor, the mover 33 may be inserted between the stators 31, 32, and the piston 42 may be inserted into the cylinder 41, in a state in which the piston 42 is coupled to the mover 33 and the outer stator 31 and inner stator 32 are assembled together, to align the concentricity of the mover 33 and piston 42. Due to this, mismatch may frequently occur in which the concentricity of the motor (M) and compressor device (C) deviate, thereby deteriorating compressor performance while causing leakage of refrigerant as abrasion between the cylinder 41 and piston 42 is increased or a gap between the cylinder 41 and piston 42 is partially out of a permissible range.

BRIEF DESCRIPTION OF THE DRAWINGS

Embodiments will be described in detail with reference to the following drawings in which like reference numerals refer to like elements, and wherein.

DETAILED DESCRIPTION

Figure 1:
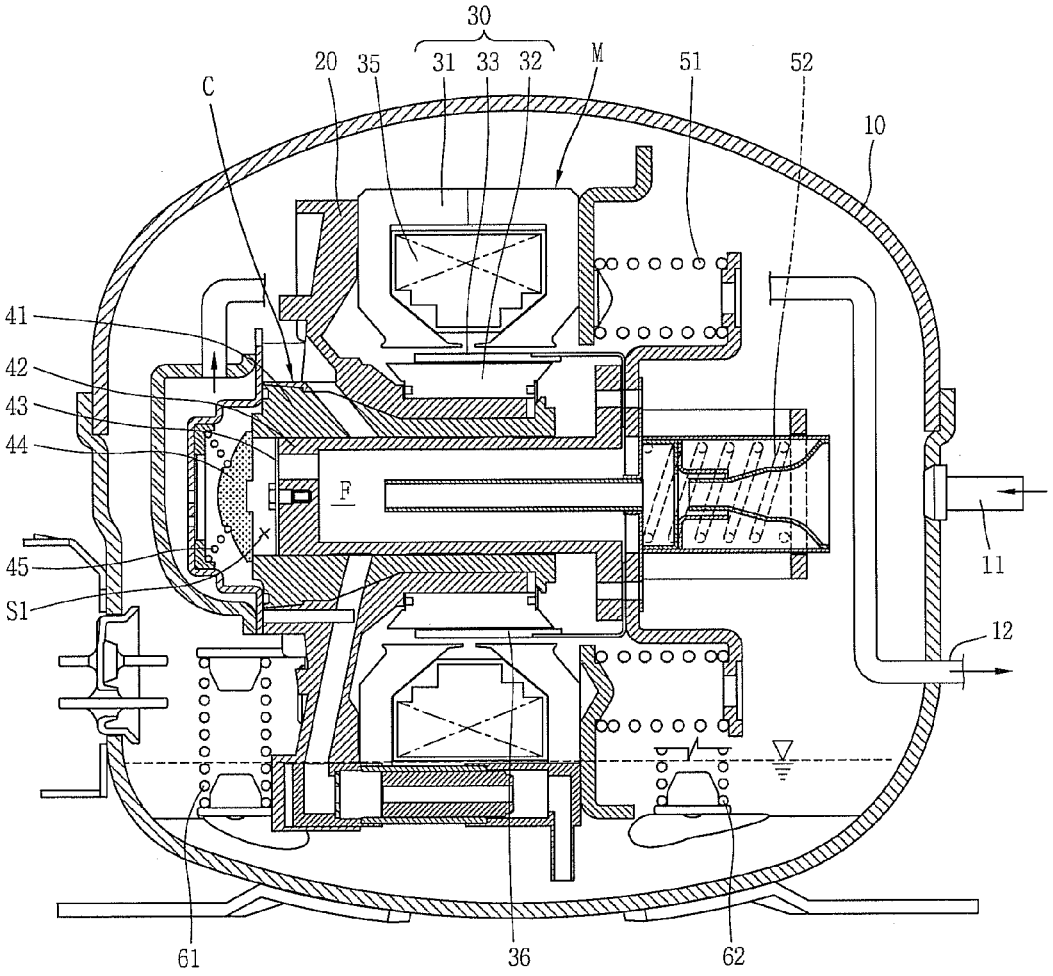
FIG. 1 RELATED ART
FIG. 1 is a longitudinal cross-sectional view of a related art reciprocating compressor.

Hereinafter, a reciprocating compressor according to embodiments will be described in detail with reference to the accompanying drawings. Where possible, like reference numerals have been used to indicate like elements, and repetitive disclosure has been amended.

Figure 2:
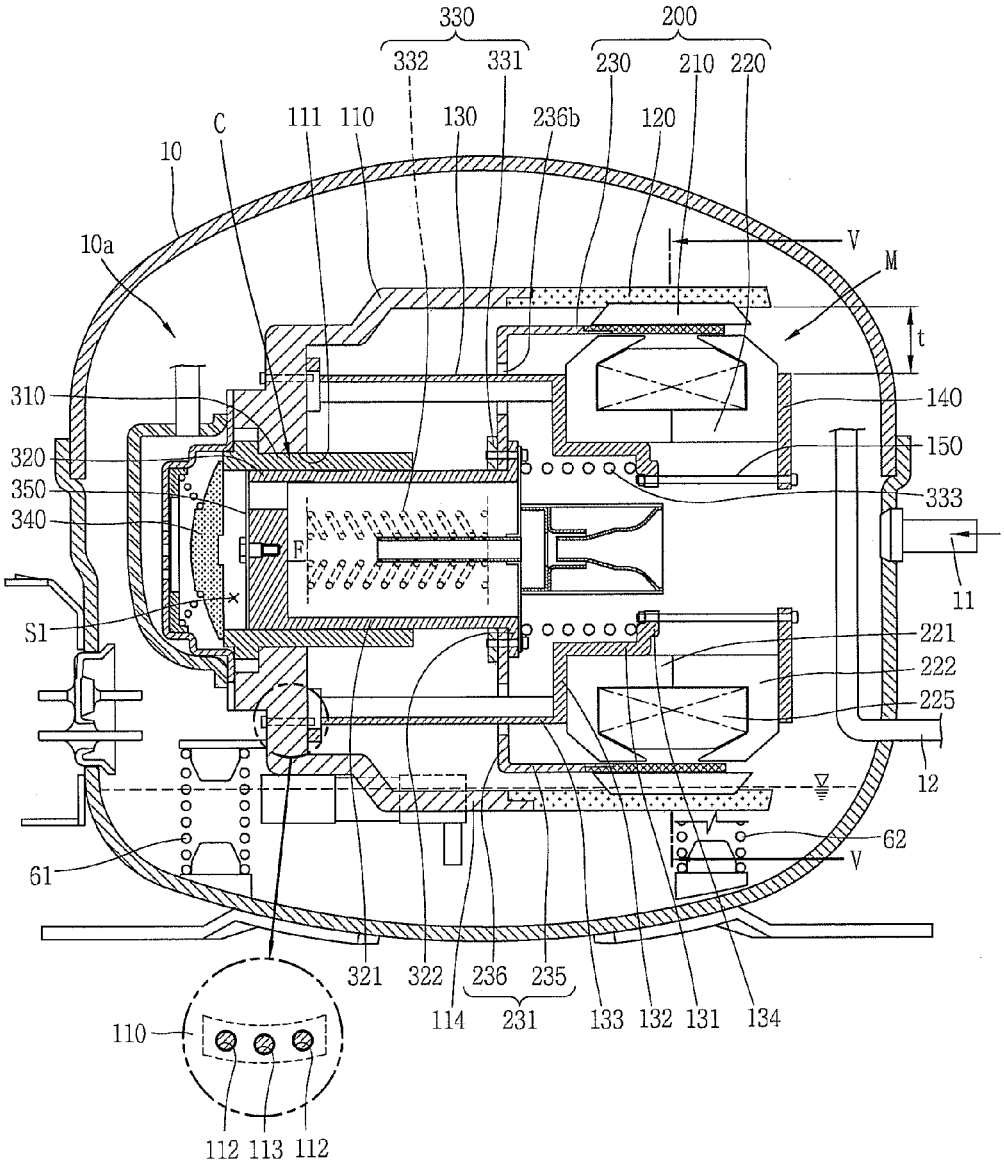
FIG. 2 is a longitudinal cross-sectional view of a reciprocating compressor according to an embodiment.
Figure 3:
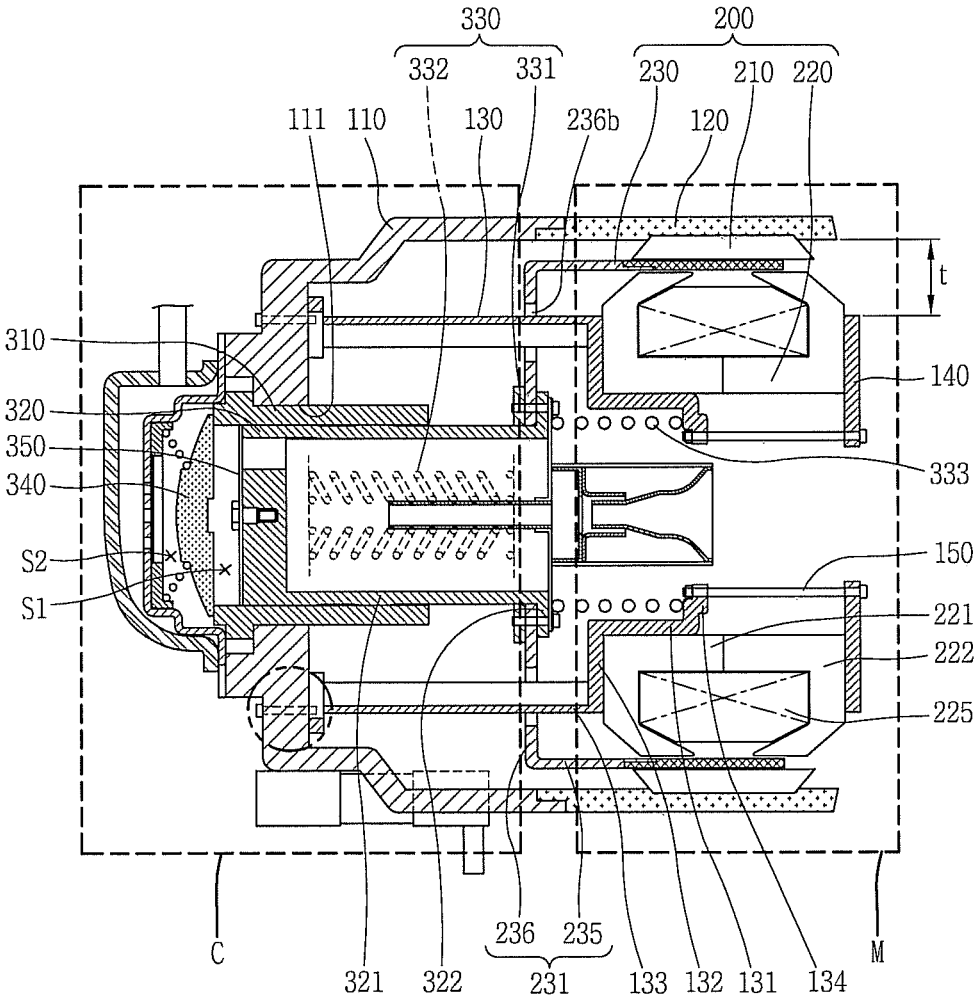
FIG. 3 is a longitudinal cross-sectional view of the reciprocating compressor of FIG. 2 in which a motor and compressor device are divided into blocks.
Figure 4:
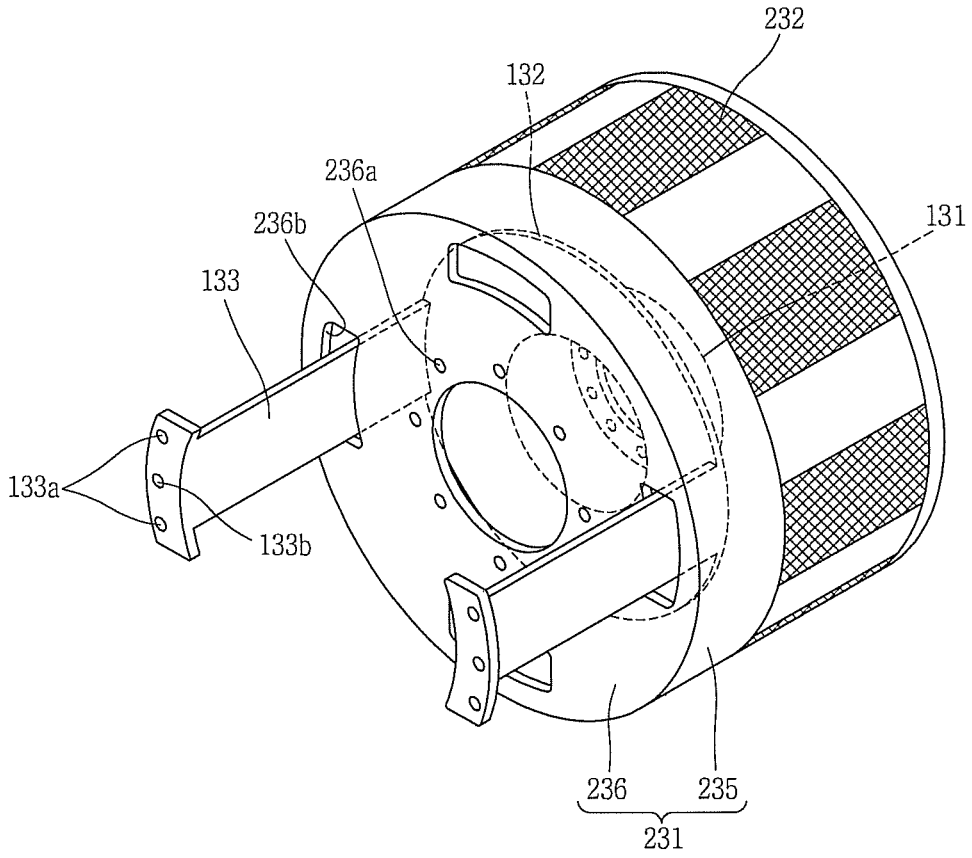
FIG. 4 is a perspective view of the reciprocating compressor of FIG. 2 in which a second support member is coupled to a magnetic holder.
Figure 5:
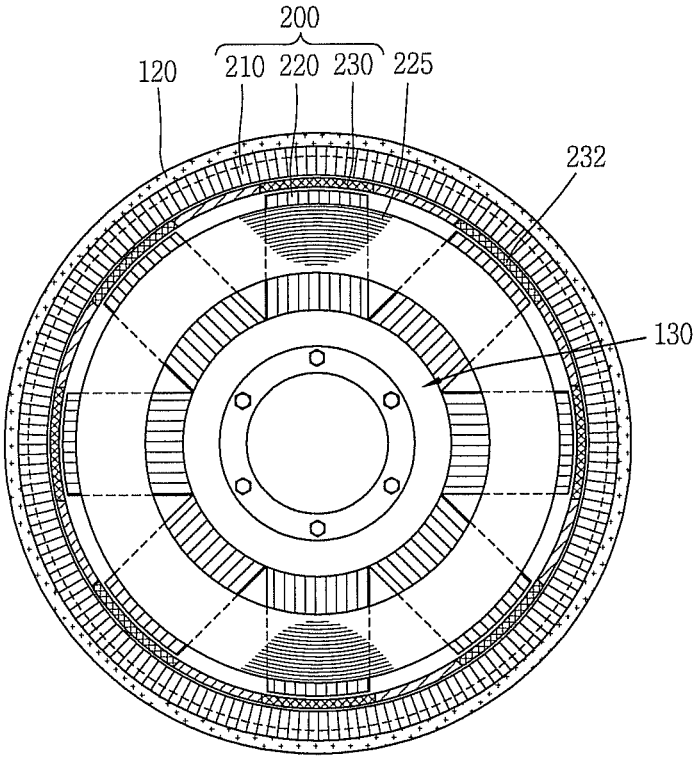
FIG. 5 is a cross-sectional view of the reciprocating compressor of FIG. 2, taken along line V-V of FIG. 2.

FIG. 2 is a longitudinal cross-sectional view of a reciprocating compressor according to an embodiment. FIG. 3 is a longitudinal cross-sectional view of the reciprocating compressor of FIG. 2, in which a motor and compressor device are divided into blocks. FIG. 4 is a perspective view of the reciprocating compressor of FIG. 2 in which a second support member is coupled to a magnetic holder. FIG. 5 is a cross-sectional view of the reciprocating compressor of FIG. 2, taken along line V-V of FIG. 2.

As illustrated in FIGS. 2-5, in a reciprocating compressor according to this embodiment, a frame 110 may be provided at an inner space 10*a* of a shell 10 to be elastically supported by a plurality of support springs 61, 62, which will be described later, a motor (M) that generates a reciprocating force may be disposed at one side of the frame 110 at a predetermined distance from the frame 110 by support members 120, 130, 140, which will be described later, and a compressor device (C) that receives the reciprocating force of the motor (M) to compress a refrigerant may be disposed between the frame 110 and the motor (M).

The inner space 10*a* of the shell 10 may be enclosed. A suction pipe 11 to guide the refrigerant of a refrigeration cycle apparatus to the inner space 10*a* of the shell 10 may be connected to the shell 10, and a discharge pipe 12 to discharge the refrigerant compressed in a compression space (S1) of the cylinder 310, which will be described later, to the refrigeration cycle apparatus may be connected to the shell 10. Further, the plurality of support springs 61, 62 may be provided at a bottom surface of the shell 10, and the motor (M) and compressor device (C), as well as the frame 110 may be elastically supported by the plurality of support springs 61, 62 to maintain a predetermined distance from the bottom surface of the shell 10.

The frame 110 may be formed in a circular disc shape, for which a cylinder hole 111 may be formed at a central portion thereof, such that the cylinder 310 may be inserted and coupled thereto. Fastening holes 112 to fasten the second support member 130, which will be described later, for example, by a fastener, such as a bolt, may be formed around the cylinder hole 111. Reference hole 113 to align a fastening position of the second support member 130 may be formed between the fastening holes 112. Further, as illustrated in FIGS. 2 and 3, a boss portion 114 may protrude in a direction of the reciprocating motor 200 at an edge of the frame 110 to be integrally coupled to the first support member 120, which will be described later. An outer diameter of the boss portion 114 may be greater than an outer diameter of a magnet holder 231, thereby facilitating assembly work of the second support member 130.

The reciprocating motor 200 forming the motor (M) may include an outer stator 210 coupled to the frame 110 by the first support member 120, an inner stator 220 disposed at an inner side of the outer stator 210 with a predetermined gap therebetween, coupled to the frame 110 by the second support member 130, and provided with a coil 225, and a mover 230 interposed between the outer stator 210 and inner stator 220 and provided with a plurality of magnets 232 corresponding to the coil 225 to perform a reciprocating movement along a direction of a magnetic flux induced by the plurality of magnets 232 and the coil 225.

The outer stator 210 may be formed, for example, in a cylindrical shape by radially laminating a plurality of sheets of thin stator cores (not shown), respectively. Alternatively, the outer stator may be integrally formed by sintering powder with a magnetic material.

The inner stator 220 may be formed, for example, in a cylindrical shape by laminating a plurality of sheets of stator cores (not shown) to form a core block 221, and then a plurality of core blocks 221 may be radially laminated on one another. The coil 225 may be a ring-shaped coil, and may be inserted into an inner portion of the inner stator 220 with a distance between pole portions being small to a minimum. Thus, a first core block 221 and a second core block 222 with an L-shape may be symmetrically coupled to each other.

The mover 230 may include a magnetic holder 231, which may be fastened, for example, by a bolt, to piston 320, and the plurality of magnets 232 coupled to an outer circumferential surface of the magnetic holder 231 to be disposed at a gap between the outer stator 210 and inner stator 220.

The magnetic holder 231 may include a magnet support portion 235 formed in a cylindrical shape to support the plurality of magnet 232, and a piston connecting portion 236 that extends in a central direction from a rear end of the magnet support portion 235 to be coupled, for example, by a bolt, to a flange portion 322 of the piston 320. A plurality of frame side fastening holes 236*a* to be coupled, for example, by a bolt, to the piston 320 may be formed along a circumferential direction of the piston connecting portion 236 of the magnetic holder 231, and a plurality of frame side through holes 236*b* may be formed around the plurality of frame side fastening holes 236*a* to allow the fixing support portion 133 of the second support member 130 to pass therethrough.

The first support member 120 may be coupled to the frame 110 and may be formed by forming a non-magnetic material, such as aluminum, in a cylindrical shape to surround an outer circumferential surface of the outer stator 210 or may be fabricated by integrally molding it on the frame 110 using, for example, an insert-die-casting or molding method. While a front end (delivery stroke direction side end portion of the piston) of the first support member 120 may be coupled to the frame 110, a rear end thereof (intake stroke direction side end portion of the piston) may be separated from the second support member 130 or third support member 140, which will be described later, by a predetermined distance (t) to prevent magnetic flux leakage. The second support member 130 and third support member 140 may be formed of a non-magnetic material, such as aluminum, similarly to that of the first support member 120.

Further, as illustrated in FIGS. 3 and 4, the second support member 130 may include an inner circumferential surface support portion 131 formed in a cylindrical shape to support an inner circumferential surface of the inner stator 220, a lateral surface support portion 132 that extends in a flange shape from a front end of the inner circumferential surface support portion 131 to support a front lateral surface of the inner stator 220, and a fixing support portion 133 that extends and is formed toward a front side with a predetermined distance along the circumferential direction from the lateral surface support portion 132 to be coupled to the frame 110. A fastening groove 133*a* and a reference groove 133*b* may be formed at an end of the fixing support portion 133 to correspond to the fastening hole 112 and reference hole 113 of the frame, respectively.

A connecting support portion 134 may be bent and extend at an inner circumferential surface of the inner circumferential surface support portion 131 to be fastened, for example, by a bolt, to the third support member 140 while at the same time supporting a rear end of the second resonant spring 333, which will be described later.

The compressor device (C) may include the cylinder 310 inserted into and coupled to the cylinder hole 111 of the frame 110, the piston 320 inserted into the cylinder 310 in a reciprocating manner to compress refrigerant, and a resonant device 330 coupled to the piston 320 to guide the resonant movement of the piston 320.

The cylinder 310 may be formed, for example, in a cylindrical shape to be inserted and coupled to the cylinder hole 111 of the frame 110, and a discharge valve 340 to open or close the compression space (S1) may be detachably provided at a leading end surface of the cylinder 310. Further, the cylinder 310 may be formed of a material having a higher rigidity than that of cast iron or at least that of the frame 110 considering abrasion due to the piston 320, as the inner circumferential surface thereof forms a bearing surface for the piston 320 made of cast iron.

The piston 320 may be formed in a penetrating manner with a suction passage (F) to inhale refrigerant into the compression space (S1) of the cylinder 310, and a suction value 350 to open or close the suction passage (F) may be provided at a leading end surface of the piston 320. Further, the piston 320 may be formed of the same material as that of the cylinder 310 or formed of a material having at least similar rigidity to that of the cylinder 310, thereby reducing abrasion to the cylinder 310.

The resonant device 330 may include a spring support 331 coupled to the piston 320, and a first resonant spring 332 and a second resonant spring 333 provided at forward and backward directions of the spring support 331, respectively. The first resonant spring 332 and second resonant spring 333 may include one for each, or both the first resonant spring 332 and second resonant spring 333 may be provided in a plural number, respectively. When the first resonant spring 332 and second resonant spring 333 are provided with one for each, it may facilitate assembly, and when the first resonant spring 332 and second resonant spring 333 are provided in a plural number, respectively, side forces may be cancelled out, thereby enhancing a straightness of the piston 320. Further, as illustrated in FIG. 2, the resonant device 330 may include a plurality of first resonant springs 332 and one second resonant spring 333.

When there is a plurality of resonant springs, any one of the plurality of resonant springs may be provided such that an end thereof faces a direction opposite to gravity, thereby preventing side forces and sagging of the mover, as well as the piston.

In the drawings, unexplained reference numeral 321 is a sliding portion of the piston 320.

The working effect of the foregoing reciprocating compressor according to embodiments will be described below.

When power is applied to the coil 221 of the reciprocating motor 200, a magnetic flux may be formed between the outer stator 210 and inner stator 220. Then, the mover 230 placed at or in a gap between the outer stator 210 and inner stator 220 may continuously perform a reciprocating movement due to the resonant device 330 while moving along a direction of the magnetic flux. Then, the piston 320 coupled to the mover 230 may repeat a series of processes of inhaling, compressing, and discharging refrigerant while performing the reciprocating movement within the cylinder 310.

The reciprocating motor 200 may be separated from the cylinder 310 forming the compressor device (C) by the first support member 120 and the second support member 130, each formed of a non-magnetic material, by a predetermined distance, thereby preventing the magnetic flux generated between the outer stator 210 and the inner stator 220 of the reciprocating motor 200 in advance from being leaked to the cylinder 310 and piston 320. Through this, the magnetic flux leakage of the reciprocating motor 200 may be reduced to enhance motor efficiency. Further, the magnetic flux generated by the reciprocating motor 200 may not be leaked to the cylinder 310 and piston 320, so as to allow the cylinder 310 and piston 320 to be formed of a magnetic material having high abrasion resistance, thereby reducing production costs of the compressor and enhancing reliability and performance.

On the other hand, in a reciprocating compressor according to embodiments, the motor (M) and compressor device (C) may be separately disposed, and the outer stator 210 and the inner stator 220 may be separately assembled, thereby facilitating concentricity of the mover 230 of the reciprocating motor 200 forming the motor (M) and the piston 320 forming the compressor device (C).

In other words, in a reciprocating compressor according to embodiments, the outer stator 210 and the frame 110 may be individually fabricated, and then, the outer stator 210 and frame 110 may be inserted into a mold to form the first support member 120 using, for example, an insert die casting method. The first support member 120 may be integrally molded on an edge surface of the frame 110 while surrounding and fixing an outer circumferential surface of the outer stator 210. As a result, a so-called outer block (B1) may be formed.

At the same time, the inner stator 220, the second support member 130, and the third support member 140 may be individually fabricated to insert the second support member 130 into an inner circumferential surface of the inner stator 220, as well as place the third support member 140 on a rear surface of the inner stator 220, and then fasten the second support member 130 with the third support member 140 using, for example, a bolt 150, thereby supporting the inner stator 220. As a result, a so-called inner block (B2) may be formed.

At the same time, the spring support 331 and the mover 230 may be coupled to the piston 320. As a result, a so-called moving block (B3) may be formed.

Figure 6:
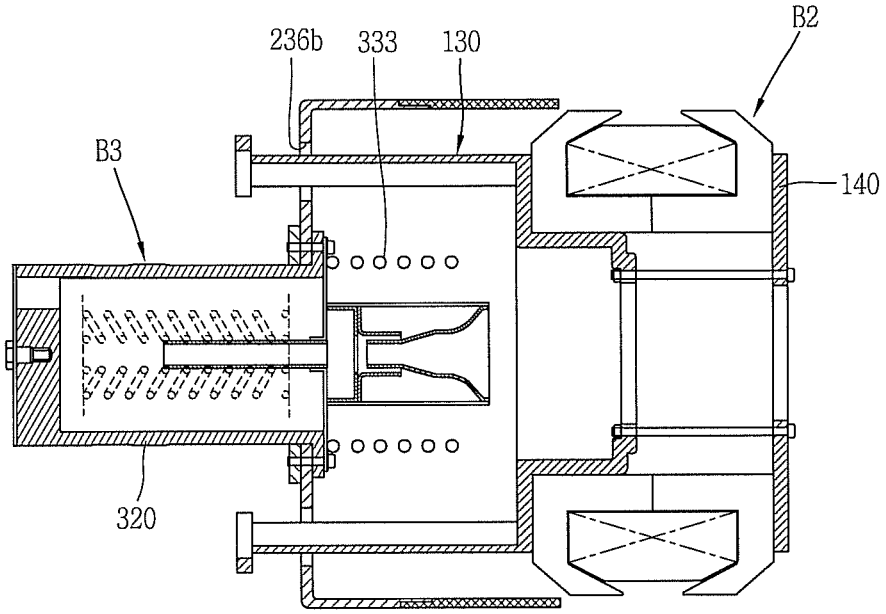
FIGS. 6 and 7 are semi-cross-sectional view illustrating an assembly process of the motor and compressor device in the reciprocating compressor of FIG. 3.

Of the foregoing blocks, the inner block (B2) and the moving block (B3) may be first assembled, and then the outer block (B1) may be assembled therewith. In other words, as illustrated in FIG. 6, the second support member 130 coupled to the inner stator 220 may be passed through the frame side through holes 236*b* of the mover 230 to allow the inner block (B2) and the moving block (B3) to be temporarily coupled to each other. At this time, the second resonant spring 333 may be inserted between the inner block (B2) and moving block (B3).

Figure 7:
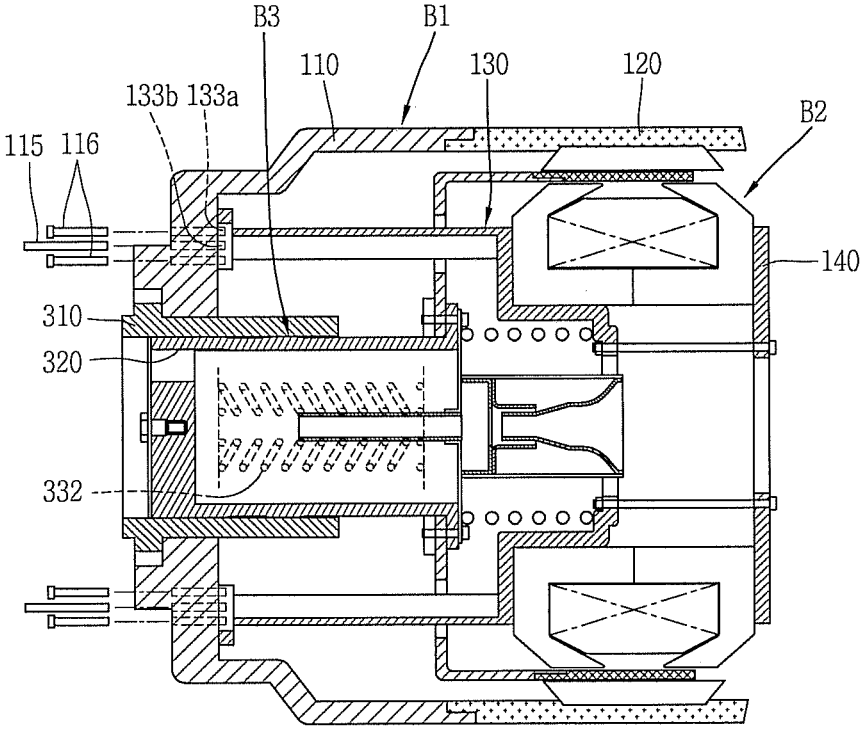

Next, as illustrated in FIG. 7, the cylinder 310 may be inserted into the frame 110 coupled to the outer stator 210, and the piston 320 coupled to the spring support 331 and mover 230 may be inserted into the cylinder 310. At this time, the plurality of first resonant springs 332 may be disposed, such that they may be located on a front surface of the spring support 331 and a rear surface of the frame 110.

Next, the assembly may be fastened and fixed to the frame 110. At this time, the concentricity of the cylinder 310 and piston 320 may be allowed to coincide with each other using a thickness gauge (not shown), in a state that the reference hole 113 of the frame 110 is inserted into the reference groove 133*b* of the second support member 130 using the reference pin 115 passing through the reference hole 113 of the frame 110, and then the frame 110 and second support member 130 may be fastened with the fastening bolt 116.

On the other hand, each of the blocks may be assembled in the following sequence. That is, the cylinder 310 may be inserted into the frame 110 coupled to the outer stator 210 forming the outer block (B1), and the piston 320 coupled to the spring support 331 and mover 230 forming the moving block (B3) may be inserted into the cylinder 310. At this time, a plurality of first resonant springs 332 may be disposed, such that they are located on a front surface of the spring support 331 and a rear surface of the frame 110.

Next, the second support member 130 coupled to the inner stator 220 constituting the inner block (B2) may be fastened and fixed to the frame 110. At this time, the concentricity of the cylinder 310 and piston 320 may be allowed to coincide with each other using a thickness gauge (not shown), in a state that the reference pin 115 passing through the reference hole 113 of the frame 110 may be inserted into the reference groove 133*b* of the second support member 130, and then, the frame 110 and second support member 130 may be bolt-fastened with each other, for example, by a bolt.

In this manner, the motor and compressor device of the reciprocating compressor may be separately disposed, and the outer stator and inner stator of the reciprocating motor may be separately assembled, thereby facilitating concentricity of the motor and compressor device. Further, the motor and compressor device of the reciprocating compressor may be divided into several blocks for assembly, thereby simplifying assembly process.

Embodiments disclosed herein provide a reciprocating compressor capable of preventing a magnetic flux generated from a motor unit or motor from being leaked to a compressor unit or device to enhance motor performance, as well as allow a material of a cylinder and piston forming the compressor unit to be formed of a ferromagnetic material having a high abrasion resistance with a low cost so as to reduce production cost and enhance reliability.

Embodiments disclosed herein further provide a reciprocating compressor capable of facilitating concentricity of the motor unit and compressor unit so as to reduce assembly costs and decrease an abrasion between the cylinder and the piston, as well as uniformly maintain a gap between the cylinder and the piston within a permissible range so as to enhance compressor performance.

Embodiments disclosed herein provide a reciprocating compressor that may include an outer stator; an inner stator provided with a predetermined gap at an inner side of the outer stator; a mover configured to perform a reciprocating movement at a gap between the outer stator and inner stator; a piston coupled to the mover to perform a reciprocating movement therewith; a cylinder into which the piston is inserted to form a compression space while performing a reciprocating movement; a frame coupled to the cylinder; a first support member coupled to the outer stator to be coupled to the frame; and a second support member separated from the first support member but coupled to the inner stator to be coupled to the frame.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A reciprocating compressor, comprising:

an outer stator;

an inner stator provided at an inner side of the outer stator with a predetermined gap therebetween;

a mover configured to perform a reciprocating movement in the gap between the outer stator and the inner stator, the mover including a manger holder coupled to the piston and at least one magnet coupled to the magnet holder;

a piston coupled to the mover to perform a reciprocating movement therewith;

a cylinder into which the piston is inserted to form a compression space while performing the reciprocating movement;

a frame coupled to the cylinder;

a first support member coupled to the outer stator and the frame; and a second support member separated from the first support member but coupled to the inner stator and the frame, wherein the second support member includes an inner circumferential surface support portion formed in a cylindrical shape to support an inner circumferential surface of the inner stator, a lateral surface support portion that extends in a flange shape from a first lateral surface of the inner circumferential surface support portion to support a first lateral surface of the inner stator, and a fixing support portion that extends in a reciprocating direction of the piston a predetermined distance from the lateral surface support portion to be coupled to the frame, wherein a through hole is formed in the magnet holder to allow the fixing support portion of the second support member to pass therethrough.

2. The reciprocating compressor of claim 1, wherein the second support member further includes:

a connecting support portion that is bent and extends from an inner circumferential surface of the inner circumferential surface support portion to be fastened with a third support member to support a second lateral surface of the inner stator.

3. The reciprocating compressor of claim 1, wherein the first support member is insert-die-cast or molded into the frame to be integrally formed therewith.

4. The reciprocating compressor of claim 1, wherein a coil is provided at the inner stator corresponding to at least one magnet provided on the mover.

5. The reciprocating compressor of claim 1, wherein the second support member is disposed on a first lateral surface in an axial direction of the inner stator, wherein a third support member is disposed on a second lateral surface in the axial direction of the inner stator, and wherein the third support member is coupled to the second support member.

6. The reciprocating compressor of claim 5, wherein the first support member, the second support member, and the third support member are each formed of a non-magnetic material.

7. The reciprocating compressor of claim 6, wherein the cylinder and piston are each formed of a magnetic material.

8. The reciprocating compressor of claim 5, wherein the first support member and the third support member are separated from each other by a predetermined distance.

9. The reciprocating compressor of claim 1, wherein a spring support member is coupled to the piston, wherein at least one first resonant spring that elastically supports the piston is provided between the spring support member and the frame, wherein the at least one first resonant spring includes a plurality of coil springs, and wherein at least one of the plurality of coil springs is provided such that an end of a winding direction thereof faces in a direction opposite to a direction of gravity.

10. A reciprocating compressor, comprising:

a reciprocating motor comprising an outer stator, an inner stator, and a mover configured to perform a reciprocating movement in a gap between the outer stator and the inner stator;

a frame disposed a predetermined distance in a reciprocating direction from the motor and provided with a cylinder into which a piston coupled to the mover is inserted;

a first support member coupled to the outer stator of the reciprocating motor; and a second support member coupled to the inner stator of the reciprocating motor, wherein the first support member and second support member are separated from each other and separately coupled to the frame, respectively, wherein the mover includes a magnet holder coupled to a piston, at least one magnet coupled to the magnet holder, and a through hole formed in the magnet holder to allow the second support member to pass therethrough.

11. The reciprocating compressor of claim 10, wherein the first support member is insert-die-cast or molded into the frame to be integrally formed therewith.

12. The reciprocating compressor of claim 11, wherein the second support member is coupled to the frame by fastening with a bolt or rivet.

13. A reciprocating compressor, comprising:

a motor block, including:

an outer stator;

a first support member coupled to the outer stator;

an inner stator provided at an inner side of the outer stator with a predetermined gap therebetween; and a second support member separated from the first support member and coupled to the inner stator; and a compression device block, including:

a mover configured to perform a reciprocating movement in the gap between the outer stator and the inner stator, the mover having through holes formed in a magnet holder of the mover to allow the second support member to pass therethrough;

a piston coupled to the mover to perform a reciprocating movement therewith;

a cylinder, into which the piston is inserted to form a compression space while performing the reciprocating movement; and a frame coupled to the cylinder, wherein the first support member and the second support member are separately coupled to the frame.

14. The reciprocating compressor of claim 13, wherein the first support member and the second support member are separately coupled to the frame such that the motor block and the compression device block do not overlap.

15. The reciprocating compressor of claim 14, wherein the second support member includes:

an inner circumferential surface support portion formed in a cylindrical shape to support an inner circumferential surface of the inner stator;

a lateral surface support portion that extends in a flange shape from a first lateral surface of the inner circumferential surface support portion to support a first lateral surface of the inner stator; and fixing support portions that extend from the lateral surface support portion in a reciprocating direction of the piston by a predetermined distance and which are provided along a circumferential direction, to be coupled to the frame through the through hole of the magnetic holder, respectively.

16. The reciprocating compressor of claim 15, wherein the second support member further includes:

a connecting support portion that is bent and extends from an inner circumferential surface of the inner circumferential surface support portion to be fastened with a third support member to support a second lateral surface of the inner stator.

17. The reciprocating compressor of claim 14, wherein the first support member is insert-die-cast or molded into the frame to be integrally formed therewith.

18. The reciprocating compressor of claim 14, wherein the second support member is provide on a first lateral surface in an axial direction of the inner stator, wherein a third support member is provided on a second lateral surface in the axial direction of the inner stator, and wherein the third support member is coupled to the second support member.

19. The reciprocating compressor of claim 18, wherein the first support member, the second support member, and the third support member are each formed of a non-magnetic material.

20. The reciprocating compressor of claim 19, wherein the cylinder and piston are each formed of a magnetic material.

* * * * *